United States Patent [19]

Kempisty

[11] Patent Number: 4,901,995

[45] Date of Patent: Feb. 20, 1990

[54] APPARATUS FOR USE IN FORMING SHEET MATERIAL ASSEMBLAGES

[75] Inventor: Edward L. Kempisty, Rouses Point, N.Y.

[73] Assignee: AM International Incorporated, Chicago, Ill.

[21] Appl. No.: 206,000

[22] Filed: Jun. 13, 1988

[51] Int. Cl.[4] ..... B65H 39/02

[52] U.S. Cl. ..... 270/54; 270/55

[58] Field of Search ..... 270/54, 55, 57, 58; 198/457

[56] References Cited

U.S. PATENT DOCUMENTS

| | | | |
|---|---|---|---|
| 3,269,720 | 8/1966 | Schluckebier | 270/57 |
| 3,360,104 | 12/1967 | Winfield | 198/457 |
| 3,674,258 | 7/1972 | Maier, Jr. et al. | 271/77 |
| 3,690,650 | 9/1972 | Maier, Jr. et al. | 271/89 |
| 3,881,716 | 5/1975 | Bryson et al. | 270/12 |
| 3,945,633 | 3/1976 | Knopp | 271/3.1 |
| 3,951,399 | 4/1976 | Reist | 270/55 |
| 4,050,573 | 9/1977 | Muller | 198/366 |
| 4,477,067 | 10/1984 | Wise | 270/55 |
| 4,479,643 | 10/1984 | Seidel | 270/55 |

FOREIGN PATENT DOCUMENTS

| | | | |
|---|---|---|---|
| 2160772 | 6/1973 | Fed. Rep. of Germany | 270/55 |

*Primary Examiner*—Randall L. Green
*Assistant Examiner*—Theresa M. Newholm
*Attorney, Agent, or Firm*—Tarolli, Sundheim & Covell

[57] ABSTRACT

An improved apparatus for forming sheet material assemblages includes a circular array of pockets which are sequentially moved through a plurality of feed stations disposed in an arcuate array. Sheet material is fed into each of the pockets in turn at the feed stations to form sheet material assemblages. A delivery conveyor conducts the completed sheet material assemblages from the circular array of pockets. A plurality of loader conveyor assemblies are provided to supply sheet material to the feed stations. One of the loader conveyor assemblies is disposed above and extends across the delivery conveyor. The loader conveyor assembly which extends across the delivery conveyor has a skewed discharge end portion which turns a stream of sheet material as it moves toward the feed station. To facilitate handling of the sheet material, a group of the loader conveyor assemblies are disposed in a group with main sections of the loader conveyor assemblies extending parallel to each other. Loader conveyor assemblies on opposite sides of a central loader conveyor assembly of the group have discharge end portions which are skewed toward the central loader conveyor assembly.

9 Claims, 5 Drawing Sheets

APPARATUS FOR USE IN FORMING SHEET MATERIAL ASSEMBLAGES

BACKGROUND OF THE INVENTION

The present invention relates to hopper loader assemblies used in an apparatus which forms sheet material assemblages.

Circular machines for forming sheet material assemblages, such as newspapers or similar articles, are disclosed in U.S. Pat. Nos. 2,461,573 and 2,634,971. During operation of these circular machines, newspapers or other sheet material assemblages are sequentially transferred from bottom opening pockets into a lapped stream on a delivery conveyor. Hopper loader assemblies, similar to the ones disclosed in U.S. Pat. Nos. 3,674,258; 3,690,650 and 3,945,633 have been used to supply sheet material to hoppers at feed stations. The use of a hopper loader assembly to supply sheet material to a circular machine which forms sheet material assemblages is disclosed in U.S. Pat. No. 3,881,716.

In the past, difficulties have been encountered in using hopper loader assemblies to supply all of the feed stations of a circular machine. This is because the delivery conveyor blocks access of a hopper loader assembly to some of the feed stations. In addition, hopper loader assemblies have previously been radially aligned with a circular array of feed stations in such a manner that conveyors in the hopper loader assemblies diverge through relatively large distances. The relatively large spacing between the conveyors in the hopper loader assemblies makes it difficult to manually supervise the operation of the hopper loader assemblies and results in inefficient use of floor space.

SUMMARY OF THE INVENTION

A known machine for use in forming sheet material assemblages includes a circular array of pockets which are sequentially moved through a plurality of feed stations. Feed mechanisms disposed at each of the feed stations sequentially feed sheet material into the pockets. When a sheet material assemblage has been formed in a pocket, the bottom of the pocket opens and the sheet material assemblage is deposited on a delivery conveyor.

The sheet feed mechanisms at the feed stations are supplied with sheet material by improved hopper loader assemblies. In order to provide access to a sheet feed mechanism at a feed station adjacent to a delivery conveyor, a hopper loader assembly is disposed above and extends across the delivery conveyor. The hopper loader assembly has a relatively long main conveyor section which extends over the delivery conveyor. A relatively short discharge conveyor section of the hopper loader assembly is angularly offset or skewed relative to the main conveyor section. The curved or bent relationship between the main and discharged conveyor sections of the hopper loader assembly enables the hopper loader assembly to extend across the delivery conveyor to a feed station which was previously inaccessible.

To facilitate manual supervision of their operation, the hopper loader assemblies are advantageously grouped with their relatively long main conveyor sections extending parallel to each other. However, sheet material supplied to a feed mechanism must enter the feed mechanism along a path which extends parallel to a radius of the circular array of feed mechanisms.

Therefore, hopper loader assemblies on opposite sides of a central hopper loader assembly have discharge conveyor sections which are skewed inwardly toward the central hopper loader assembly. This enables the discharge conveyor section of each hopper loader assembly to conduct a stream of sheet material to a feed station along a path which extends parallel to a radius through a center of the feed station. However, the relatively long main conveyor sections of the hopper loader assemblies on opposite sides of a central hopper loader assembly are skewed relative to radii through the centers of the feed stations.

Accordingly, it is an object of this invention to provide a new and improved apparatus for forming sheet material assemblages by sequentially moving a circular array of pockets through feed stations and wherein a hopper loader assembly for supplying sheet material to a feed station extends above and across a delivery conveyor for the sheet material assemblages.

Another object of this invention is to provide a new and improved apparatus for use in forming sheet material assemblages and wherein the apparatus includes a circular array of pockets which are sequentially moved through feed stations and a plurality of hopper loader assemblies which supply sheet material to the feed stations, the plurality of hopper loader assemblies includes a pair of conveyor assemblies which are disposed on opposite sides of a central conveyor assembly and extend parallel to the central conveyor assembly throughout at least a major portion of their length.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
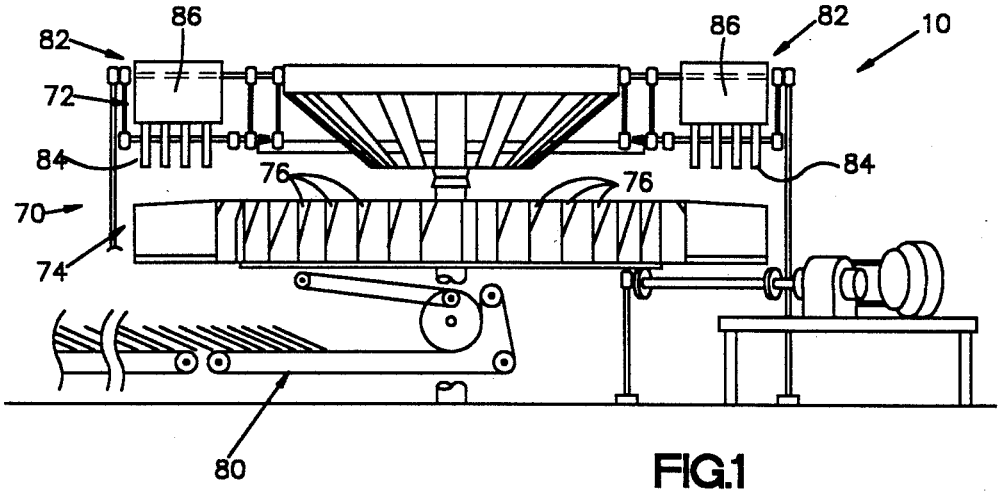
FIG. 1 is an elevational view of a known apparatus which is used to form sheet material assemblages.
Figure 2:
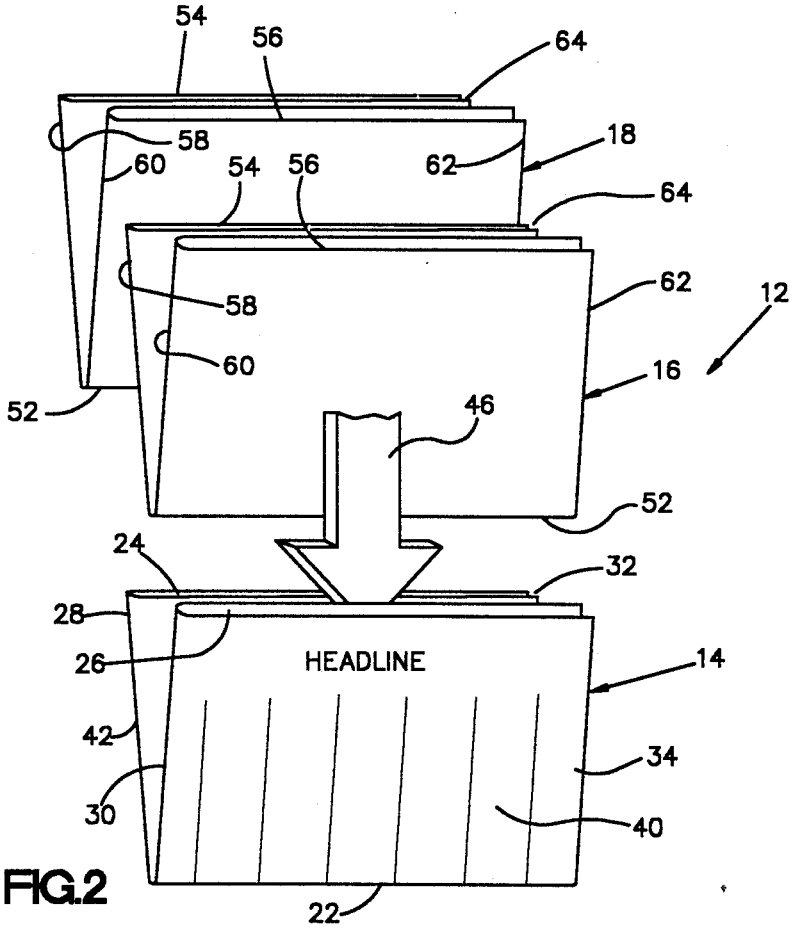
FIG. 2 is a schematic illustration of the manner in which a sheet material assemblage is formed by the apparatus of FIG. 1.

A known sheet material handling apparatus or machine 10 (FIG. 1) is operable to form sheet material assemblages 12 (FIG. 2). Each sheet material assemblage 12 includes a jacket or folded cover section 14 (FIG. 2) which encloses a plurality of folded inner sections 16 and 18. Although only two inner sections 16 and 18 have been illustrated in FIG. 2, it should be understood that any desired number of inner sections can be assembled into the jacket 14 by the apparatus 10. Although the sheet material assemblage 12 could take many different forms, for example, a booklet or group of signatures, the sheet material assemblage 12 is a newspaper.

The jacket section 14 (FIG. 2) has a main folded edge 22 and a pair of cut or open edges 24 and 26 which are opposite from and extend parallel to the main folded edge 22. A pair of folded side or secondary edges 28 and 30 extend between the folded main edge 22 and the cut or open main edges 24 and 26. In addition, a pair of cut or open side or secondary edges 32 and 34 are disposed opposite from the side folded edges 28 and 30 and also extend between the main folded edge 22 and the main open edges 24 and 26. A headline side 40 of the jacket section 14 extends between the main folded edge 22 and the main front open edge 26. Similarly, a back side 42 extends between the main folded edge 22 and the main rear open edge 24.

The inner sections 16 and 18 have the same general construction as the jacket 14 and are disposed in a side-by-side relationship inside the jacket 14, in the manner indicated schematically by the arrow 46 in FIG. 2. Thus, each of the inner sections 16 and 18 has a main folded edge 52 disposed opposite from and extending parallel to main cut or open edges 54 and 56. The inner sections 16 and 18 also have folded secondary edges 58 and 60 which extend between the main folded edge 52 and the main cut or open edges 54 and 56. In addition, the inner sections 16 and 18 have cut or open secondary edges 62 and 64 which extend between the main folded edge 52 and the main cut or open edges 54 and 56.

The sheet material handling apparatus 10 (FIG. 1) includes a collating conveyor assembly 70 having a stationary circular infeed section 72. The infeed section 72 is disposed directly above and in a coaxial relationship with a movable circular rotor or collating conveyor section 74 having a plurality of collating spaces or pockets 76. The pockets 76 are disposed in an annular array and have radially extending bottom sections which open to enable sheet material assemblages or newspapers 12 to drop downwardly to a delivery conveyor assembly 80.

The infeed section 72 includes a circular array of feed stations 82. A sheet material feed mechanism 84 is disposed at each feed station 82. Each feed mechanism 84 feeds either a jacket section 14 or an inner section 16 or 18 downwardly from a hopper 86 into each of the pockets 76 in turn.

During operations of the apparatus 10, the jacket sections 14 and inner sections 16 and 18 are sequentially fed from the hoppers 86 into the moving pockets 76 of the circular rotor 74 by the feed mechanisms 84 which are disposed beneath the hoppers 86. The jacket sections 14 are sequentially fed into the pockets 76 with the main fold 22 downward and disposed along a radius of the circular array of pockets 76. Similarly, the inner sections 16 and 18 are sequentially fed into the open jacket sections 14 in the pockets 76 with the main folds 52 downward and disposed along a radii of the circular array of pockets 76. Each jacket section 14 opens upwardly with the cut main edges 24 and 26 spaced apart to receive the inner sections 16 and 18 in a manner similar to that illustrated in FIG. 2. The sheet material handling apparatus 10 is constructed in the same manner as disclosed in U.S. Pat. No. 2,461,573.

Figure 3:
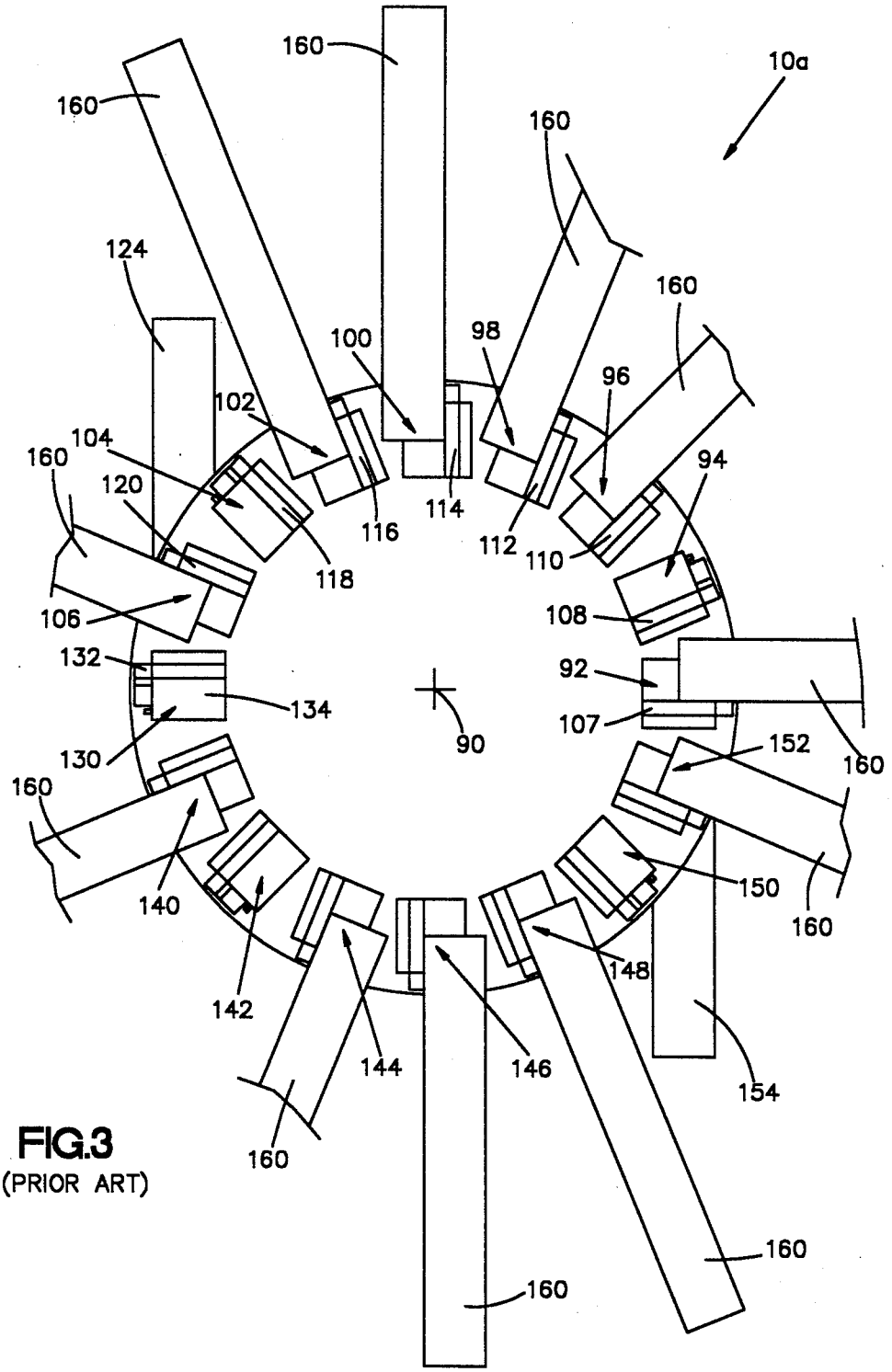
FIG.3 (PRIOR ART)
FIG. 3 is a schematic plan view, on a horizontal plane, of a sheet material assembling apparatus, similar to the apparatus of FIG. 1, and depicting the manner in which known hopper loader assemblies have previously been used to supply sheet material to feed stations.

A prior art sheet material handling apparatus 10*a* of FIG. 3 has the same general construction and mode of operation as the sheet material handling apparatus 10 of FIG. 1. However, two complete sheet material assemblages are sequentially formed in each pocket of the rotor during each revolution of the rotor. As the circular rotor rotates in a counter-clockwise direction (as viewed in FIG. 3) about a vertical central axis 90, pockets sequentially pass through a plurality of feed stations 92, 94, 96, 98, 100, 102, 104 and 106 which are disposed in a circular array. As this happens, feed mechanisms 107, 108, 110, 112, 114, 116, 118 and 120 sequentially feed a single jacket section and a plurality of inner sections, similar to the jacket section 14 and inner sections 16 and 18, into bottom opening pockets, corresponding to the pockets 76 of FIG. 1. Thus, at each of the inner section 16 feed stations 94-106, an inner section 16 is fed downwardly into a jacket section 14 with a main fold 52 of the inner section aligned with a radius of the array of feed stations.

At the feed station 106, the sheet material assemblages are completed. As the pockets leave the feed station 106, the bottom of the pockets open and drop completed sheet material assemblages downwardly onto a delivery conveyor 124 in the same manner as in which sheet material assemblages are dropped from the pockets 76 onto the conveyor 80 of FIG. 1. The delivery conveyor 124 transports the completed sheet material assemblages in a lapped stream away from the sheet material assembling apparatus 10*a*.

At the next succeeding feed station 130, a jacket feed mechanism 132 is operable to feed a jacket, similar to the jacket 14, downwardly from a hopper 134 into a now closed pocket. Continued rotation of the circular array of pockets moves each pocket in turn through feed stations 140, 142, 144, 146, 148, 150 and 152 where inner sections, similar to the inner sections 16 and 18 of FIG. 2, are inserted into the open jackets. The jackets 14 are supported in each of the pockets 76 with the main fold 22 extending parallel to a radius extending from a vertical center 90 of the circular sheet material collating apparatus 10*a*. Therefore, the inner sections, similar inner sections 16 and 18, are fed into the open jackets with the main folds 52 of the inner sections also disposed along radii extending from the center 90.

After the final inner section has been inserted into a sheet material assemblage 12 at the feed station 152, the bottom of a pocket opens and deposits the completed sheet material assemblage on a delivery conveyor 154. The delivery conveyor 154 transports the completed sheet material assemblages in a lapped stream to a location where they are bundled or otherwise processed.

The sheet material assembling apparatus 10*a* of FIG. 3 has a known construction which enables two complete sheet material assemblages to be formed in each pocket during each complete revolution of the the stationary circular array of feed stations 92–106, 130 and 142–152. However, the sheet material assembling apparatus 10*a* can be operated in such a manner as to form only a single sheet material assemblage on each complete revolution of the rotor. If this is done, the completed sheet material assemblages would be deposited on only one of the delivery conveyors 124 or 154.

During operation of the sheet material assembling apparatus 10*a*, it is necessary to supply the feed stations with jackets or inner sections. Thus, the diametrally opposite jacket feed stations 92 and 130 are supplied with jackets, similar to the jacket 14 of FIG. 2. The two arcuate arrays of inner section feed stations 94–106 and 140–152 are supplied with inner sections similar to the inner sections 16 and 18 of FIG. 2. The jackets 14 and inner sections 16 and 18 may be supplied to hoppers, corresponding to the hoppers 86 of FIG. 1, by the use of hopper loader assemblies 160 (FIG. 3).

The known hopper loader assemblies 160 can be moved between adjacent feed stations, for example between the feed stations 140 and 142, to supply the feed stations with sheet material. The straight hopper loader assemblies 160 have a construction similar to that disclosed in U.S. Pat. Nos. 3,674,258 and 3,690,650. The straight hopper loader assemblies 160 have previously been used to conduct jackets or inner sections to the feed stations for the sheet material assembling apparatus 10*a* (FIG. 3) in a manner similar to that disclosed in U.S. Pat. No. 3,881,716.

The known hopper loader assemblies 160 (FIG. 3) cannot be used to supply sheet material to the feed stations 104 and 150. This is because the delivery conveyors 124 and 154 block access of the hopper loader assemblies 160 to these feed stations. In addition, the length of the delivery conveyors 124 and 154 must be relatively short in order to enable the long straight hopper loader assemblies 160 (FIG. 3) to be used to supply inner sections to the feed stations 102 and 148.

The hopper loader assemblies 160 have previously been positioned relative to the feed stations with central axes of the hopper loader assemblies aligned with radii from the center 90 through a central portion of each of the feed stations (see FIG. 3). The straight hopper loader assemblies 160 must be radially aligned with the feed stations at which they can be used, that is, at the feed stations 92–102, 106, 130, 140–148, and 152. This is necessary in order to feed sheet material into the hoppers at the feed stations with the main folded edge of the sheet material radially aligned with the circular array of pockets beneath the feed stations.

A main folded edge 22 (FIG. 2) of each jacket section 14 must be fed into a hopper, similar to the hopper 86 of FIG. 1, with the main folded edge disposed along a radius from the axis 90 (FIG. 3). The main folded edges 52 of the inner sections 16 and 18 must also be aligned with radii from the central axis 90 when the inner sections are in hoppers at the feed stations. This is necessary to enable the jacket sections 14 and inner sections 18 to be fed from the hoppers with their main folded edges 22 and 52 aligned the pockets. Thus, the bottom of each pocket is aligned with a radius from the axis 90. The jackets and inner sections must be fed into the pockets with their main folded edges 22 and 52 also aligned with a radius from the axis 90.

The radial alignment of the straight hopper loader assemblies 160 with the feed stations results in the hopper loader assemblies 160 fanning radially outwardly from the circular array of feed stations (FIG. 3). Since the hopper loader assemblies 160 are relatively long, the outer end portions of adjacent hopper loader assemblies are spaced a substantial distance apart. This wide spacing makes it difficult to manually supervise the operation of each of the hopper loader assemblies 160 and results in a very inefficient use of the available floor space.

In order to obtain access to the feed stations 104 and 150, hopper loader assemblies 166 (FIG. 4), constructed in accordance with a feature of the invention, are used. The improved hopper loader assemblies 166 have relatively long straight main conveyor sections 172 which extend over the delivery conveyors 124 and 154 to a location adjacent to the feed stations 150 and 104. Relatively short discharge conveyor sections 176 are connected with the main conveyor sections 172 of the hopper loader assemblies 166 at curves or bends 180. The discharge conveyor sections 176 of the hopper loader assemblies 166 extend along radii from the central axis 90 of the sheet material assembling apparatus 10*a*.

The longitudinal central axis of the main conveyor section 172 (FIG. 4) of a hopper loader assembly 166 which supplies the feed station 150, extends at a relatively large acute angle of approximately 65°, as viewed in a horizontal plane, relative to the central aXis of the delivery conveyor 154. The longitudinal central axis of the main conveyor section 172 of the hopper loader 166 is also skewed at an acute angle of approximately 25°, as viewed in a horizontal plane, relative to a radius extending through the center of the feed station 150 from the central axis 90 of the sheet material assembling apparatus 10*a*. It should be understood that the longitudinal central axis of the main conveyor section 172 (FIG. 4) may not be straight and horizontal. However, the longitudinal central axis of the main conveyor section 172 is straight as viewed in a horizontal plane, that is, in the plane of paper in FIG. 4.

The relatively short discharge conveyor section 176 of the hopper loader assembly 166 has a central axis which, as viewed in a horizontal plane, extends parallel to a radius extending from the vertical center 90 of the sheet material handling apparatus 10*a* through the center of the feed station 150. Since the discharge conveyor section 176 extends parallel to a radial axis through the center of the feed station 150, inner sections 16 or 18 can be fed by the hopper loader assembly 166 to a hopper at the feed station 150 with a main fold line 52 of the inner section parallel to radial axis through the center of the feed station. It should be understood that the longitudinal central axis of the discharge conveyor section 176 may not be straight and horizontal. However, the longitudinal central axis of the discharge conveyor section 176 is straight as viewed in a horizontal plane, that is, in the plane of the paper in FIG. 4.

The bend 180 between the main conveyor section 172 and discharge conveyor section 176 of the hopper loader assembly 166 (FIG. 4) is disposed directly over the delivery conveyor 15. In the absence of the bend 180, the hopper loader assembly 166 could not be used to supply inner sections to the feed station 150. This is because if the longitudinal central axis of the hopper loader assembly 166 was straight and the hopper loader assembly was aligned with the central axis through the feed station 150, the supports for the hopper loader assembly would interfere with the delivery conveyor 154.

If the hopper loader assembly 166 was straight throughout its length and was oriented with its longitudinal central axis skewed relative to the radial axis extending through the center of the feed station 150, the stream of signatures would not be properly oriented relative to the hopper at the feed station. By providing the hopper loader 166 with a relatively long main section 172 and a short discharge section 176 which are skewed at an acute angle of approximately 25° relative to each other, the hopper loader assembly 166 can be positioned relative to the conveyor 154 without the supports for the hopper loader assembly interfering with the conveyor. This is because there is a relatively short length of the hopper loader assembly 166 over the conveyor 80.

The hopper loader assembly 166 at the feed station 104 is disposed above and extends across the delivery conveyor 124. The curved or bent configuration of the hopper loader assembly 166 enables it to supply a stream of sheet material articles to the feed station 104. The angled or skewed relationship between the discharge section 176 and main section 172 of the hopper loader assembly 166 for the feed station 104 enables the hopper loader assembly to extend over and across the delivery conveyor 124 without the supports for the hopper loader assembly interfering with the delivery conveyor.

Figure 4:
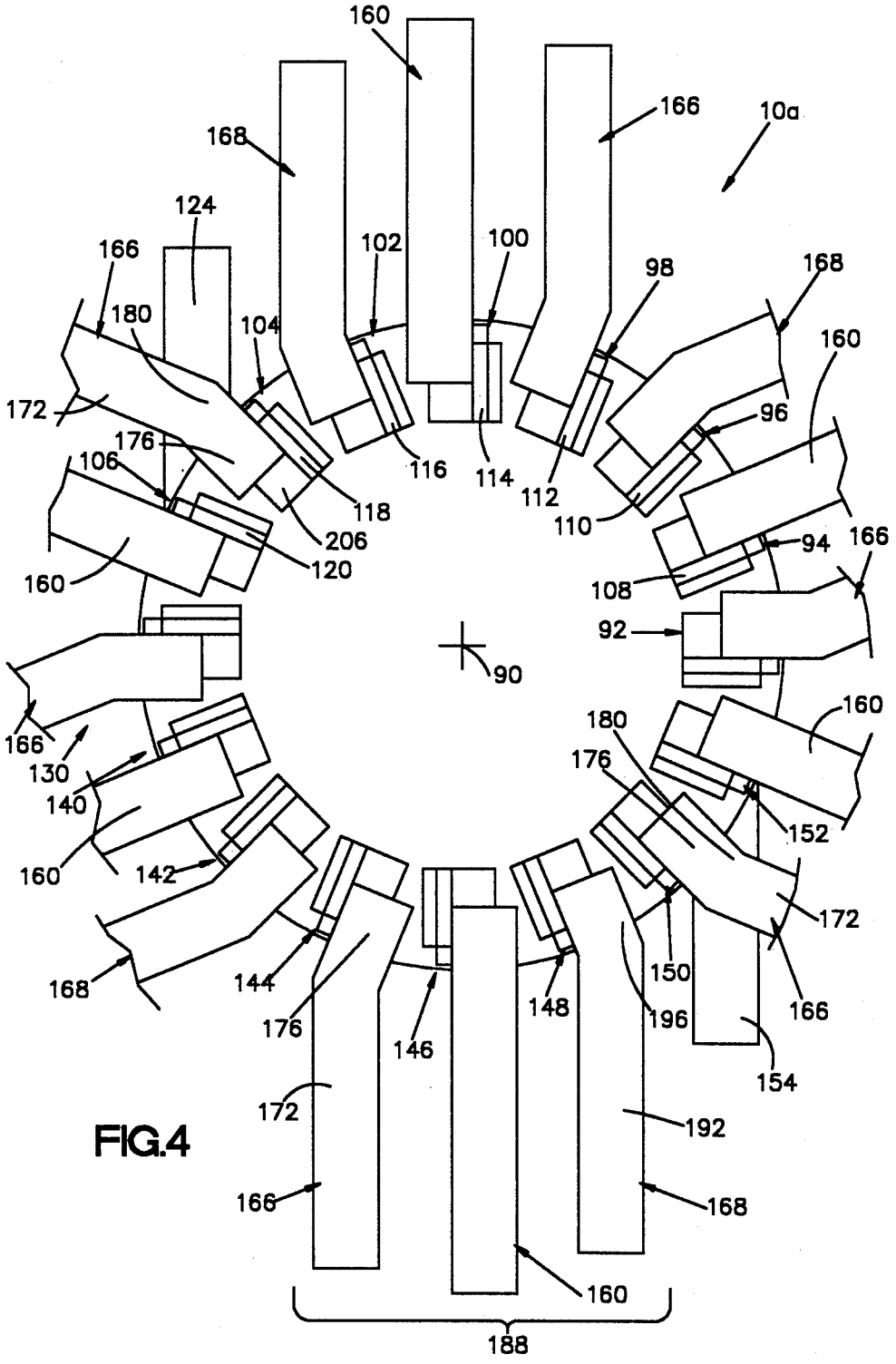
FIG. 4 is a schematic plan view, on a horizontal plane and generally similar to FIG. 3, illustrating the manner in which hopper loader assemblies constructed in accordance with the present invention are used to feed sheet material to supply stations in the apparatus of FIG. 3.

In order to promote the efficient utilization of both man power and floor space during operation of the hopper loader assemblies to conduct sheet material to the various feed stations, the hopper loader assemblies are advantageously positioned in groups, such as the group 188 in FIG. 4. The group 188 of hopper loader assemblies includes a central hopper loader assembly 160, a left hopper loader assembly 166 and a right hopper loader assembly 168. The known central hopper loader assembly 160 is straight throughout its length.

The relatively long main sections 172 and 192 of the hopper loader assemblies 166 and 168 extend parallel to and are spaced equal distances from the straight central hopper loader assembly 160. However, the discharge section 176 of the left hopper loader assembly 166 is skewed or curved toward the right (as viewed in FIG. 4) in a direction toward the central hopper loader assembly 160. Similarly, the right hopper loader assembly 168 has a discharge section 196 which is skewed or curved toward the left (as viewed in FIG. 4) in a direction toward the central hopper loader assembly 160.

Since the main conveyor sections 172 and 192 of the hopper loader assemblies 166 and 168 extend parallel to each other and to the central hopper loader assembly 160, uniform passages or aisles are formed between the main sections 172 and 192 of the hopper loader assemblies 166 and 168 and the central hopper loader assembly 160. The uniform aisles between the hopper loader assemblies 160, 166 and 168 facilitate manual adjustment of sheet material on the hopper loader assemblies. In addition, since the main sections 172 and 192 of the hopper loader assemblies 166 and 168 extend parallel to the central hopper loader assembly 160 rather than being formed as a continuation of the discharge sections 176 and 196, the group 188 of hopper loader assemblies 160, 166 and 168 require a relatively small amount of floor space. This results in a substantial open area for access to the adjacent feed station 142 and 150.

Figure 5:
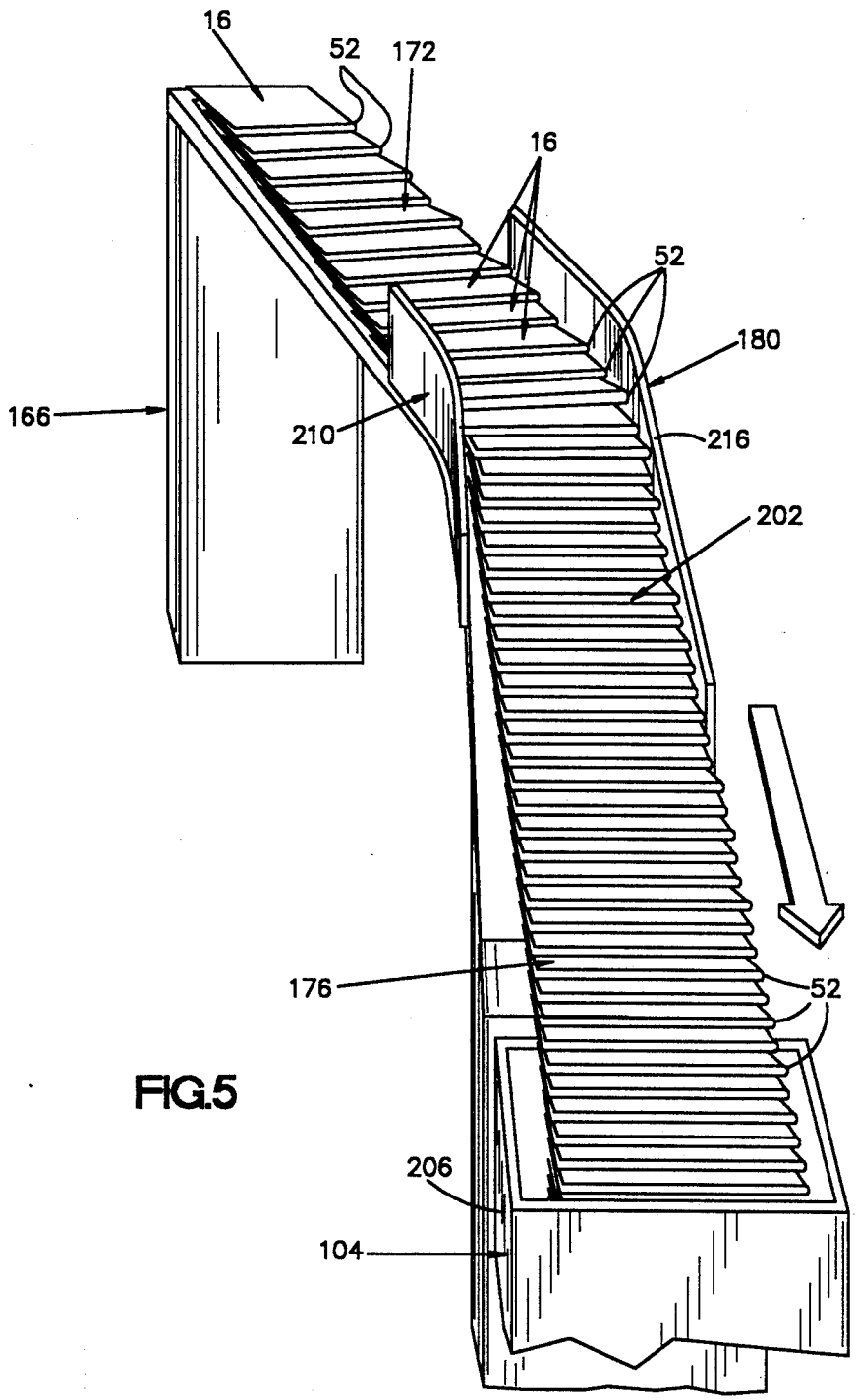
FIG. 5 is a schematicized pictorial illustration of the manner in which a stream of sheet material is conducted to a feed station by an improved hopper loader assembly of FIG. 4.

The manner in which a lapped stream 202 of inner sections 16 is conveyed by the hopper loader assembly 166 to the feed station 104 is illustrated schematically in FIG. 5. The main folded edges 52 of the inner sections 16 extend generally parallel to the longitudinal central axis of the hopper loader assembly 166 so that inner sections are transferred to a hopper 206 at the feed station 104 with the main folded edges 52 extending parallel to a radial axis through the center of the feed station 104. This results in each inner section 16 being positioned so that it can move straight downwardly into a pocket 76 with the main fold line 52 disposed along a radius extending outwardly from the central axis 90 of the sheet material assembling apparatus 10*a*.

At the bend 180 between the main conveyor section 172 and the discharge conveyor section 176 of the hopper loader assembly 166, guides are provided to turn the stream 202. Thus, a guide wall 210 (FIG. 6) is provided on the inside of the bend 180 between the main section 172 and discharge section 176 of the hopper loader assembly 166 to guide the stream 202 around the bend 180. The guide wall 210 engages the cut edges 54 and 56 of the inner sections 16 opposite from the main folded edge 52.

Figure 7:
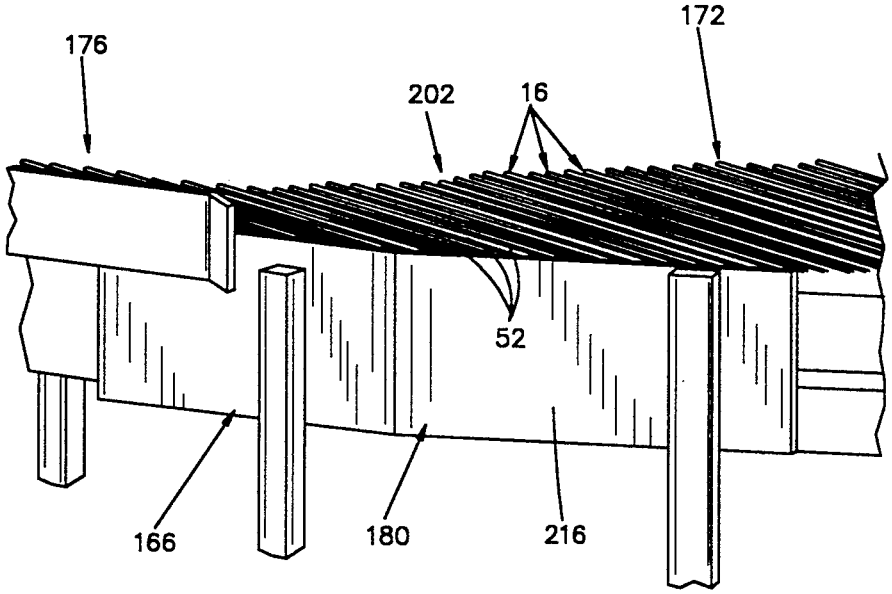
FIG. 7 is a schematic pictorial illustration, generally similar to FIG. 6, illustrating a guide member disposed on the outside of a curve or bend in the hopper loader assembly of FIG. 5.

A second guide wall 216 is provided at the outside of the bend 180 (FIG. 7). The outside guide wall 216 cooperates with the inside guide wall 210 to turn the lapped stream of inner sections 52 around the bend 180. The main folded edges 52 of the inner sections 16 engage the side wall 216 and slide along an inside surface of the sidewall 216 at the bend 180.

Figure 6:
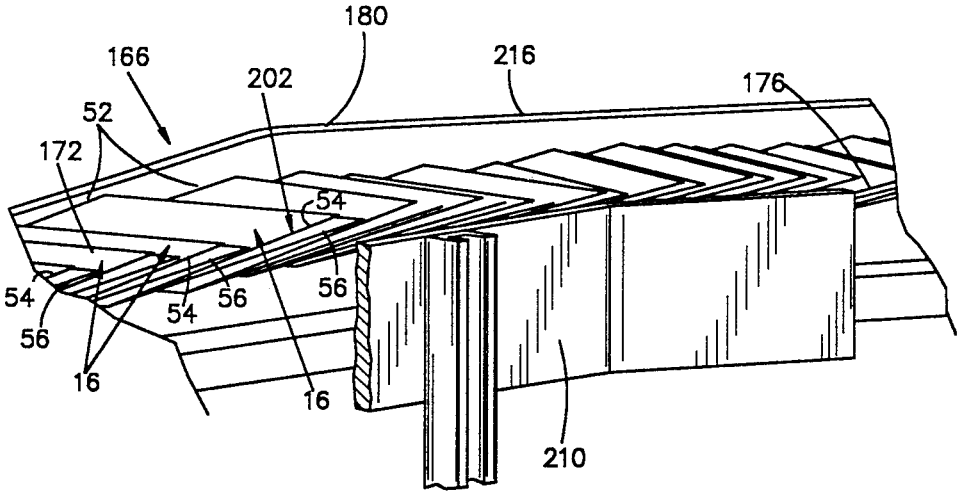
FIG. 6 is a schematic pictorial illustration depicting a guide member disposed on the inside of a curve or bend in the hopper loader assembly of FIG. 5.

Although the construction of only the hopper loader assembly 166 has been illustrated in FIGS. 5 through 7 it should be understood that the hopper loader assembly 168 has a construction which is similar to the construction of the hopper loader assembly 166. However, the bend or curve in the hopper loader assembly 168 is of the opposite hand as the bend or curve 180 in the hopper loader assembly 166. Thus, the hopper loader assembly 166 bends or curves its stream of material toward the right as the stream flows from the main section 172 to the discharge section 176. The hopper loader assembly 168 bends or curves a stream of material toward the left as the stream flows from the main section 192 to the discharge section 196. By having the hopper loader assemblies 166 and 168 constructed with bends or curves of opposite hand, the main sections of the hopper loader assemblies 160, 166 and 168 in the group 188 all extend parallel to each other in the group 188 (FIG. 4).

CONCLUSION

In view of the foregoing description, it is apparent that a known machine 10*a* (FIG. 4) for use in forming sheet material assemblages includes a circular array of pockets which are sequentially moved through a plurality of feed stations 92–106, 130 and 140–152, in the same manner as in which the pockets 76 (FIG. 1) are moved through feed stations 82. Feed mechanisms, similar to the feed mechanisms 84 of FIG. 1, disposed at each of the feed stations 92–106, 130 and 140–152 sequentially feed sheet material into the pockets. When a sheet material assemblage has been formed in a pocket, the bottom of the pocket opens and the sheet material assemblage is deposited on a delivery conveyor 124 or 154.

The sheet feed mechanisms at the feed stations 92–106, 130 and 140–152 can be supplied with sheet material by the improved hopper loader assemblies 166 or 168. In order to provide access to a feed station 104 or 150 disposed adjacent to a delivery conveyor 124 or 154, a hopper loader assembly 166 is disposed above and extends across the delivery conveyor. The hopper loader assembly 166 has a relatively long main conveyor section 172 which extends over the delivery conveyor 124 or 154. A relatively short discharge conveyor section 176 of the hopper loader assembly 166 is angularly offset or skewed relative to the main conveyor section 172 of the hopper loader assembly. The curved or bent relationship between the main and discharged conveyor sections 172 and 176 of the hopper loader assembly 166 enables the hopper loader assembly to extend across the delivery conveyor 124 or 154 to a feed station 104 or 150 which was previously inaccessible.

To facilitate manual supervision of their operation, the hopper loader assemblies 160, 166 and 168 are advantageously placed in a group 188. The relatively long main sections 172 and 192 of the hopper loader assemblies 166 and 168 are parallel to each other and to a straight central hopper loader assembly 160. However, sheet material supplied to a feed station 144 or 148 must enter the feed station along a path which extends parallel to a radius of the circular array of feed stations. Therefore, hopper loader assemblies 166 and 168 on opposite sides of a central hopper loader assembly 160 have discharge sections 176 and 196 which are skewed inwardly toward the central hopper loader assembly. This enables the discharge section of each hopper loader assembly 160, 166 or 168 to feed a stream of sheet material to a feed station 144, 146 or 148 along a path which extends parallel to a radius through a center of the feed station. However, the relatively long main sections 172 and 192 of the hopper loader assemblies 166 and 168 are skewed relative to the radii through the center of feed stations 144 and 148 so as to extend parallel to each other and the straight central hopper loader assembly 160.

Having describe a specific preferred embodiment of the invention, the following is claimed:

1. An apparatus for use in forming sheet material assemblages, said apparatus comprising a plurality of feed stations disposed in an arcuate array, a circular array of pockets, means for sequentially moving each pocket in said circular array of pockets through a lower portion of each of said feed stations, feed means at an upper portion of each of said feed stations for feeding sheet material downwardly into each of said pockets in turn to form sheet material assemblages, delivery conveyor means for receiving a sheet material assemblage from a lower portion of each of said pockets in turn and conducting sheet material assemblages away from said circular array of pockets, and loader conveyor means for supplying sheet material to a feed means at one of said feed stations, said loader conveyor means being disposed above and extending across said delivery conveyor means to said one feed station, said loader conveyor means including a first conveyor section having a central axis which, as viewed in a horizontal plane, is skewed relative to a radius of said circular array of pockets and extends through said one feed station, a second conveyor section having an central axis which, as viewed in a horizontal plane, extends parallel to said radius through said one feed station, and a bend section which interconnects said first and second sections, said first, second and bend sections of said loader conveyor means including surface means for supporting the sheet material in a continuous stream which extends through said bend section, said loader conveyor means further including guide surface means extending between said first and second sections for engaging and turning the continuous stream of sheet material as it moves through said bend section.

2. An apparatus as set forth in claim 1 wherein said first and second conveyor sections intersect over said delivery conveyor means.

3. An apparatus as set forth in claim 1 wherein said feed means at said one feed station is operable to sequentially feed sheet material downwardly to said pockets with a main folded edge portion of the sheet material leading and disposed in parallel relationship with a radius of the circular array of pockets, said loader conveyor means being operable to conduct sheet material in an overlapped stream to said one feed station with edge portions of the sheet material other than the main folded edge portions leading.

4. An apparats for use in forming sheet material assemblages, said apparatus comprising a plurality of feed stations disposed in an arcuate array, a circular array of pockets, means of sequentially moving each pocket in said circular array of pockets through each of said feed stations, feed means at each of said feed stations for feeding sheet material into each of said pockets in turn to form sheet material assemblages, and a plurality of loader conveyor means for supplying sheet material to a plurality of said feed means disposed at adjacent feed stations in the arcuate array of feed stations, said plurality of loader conveyor means including a first loader conveyor means extending outwardly from a first one of said feed means in a direction parallel to a radius of said circular array of pockets, a second loader conveyor means extending outwardly from a second one of said feed means, said second loader conveyor means includes a relatively long first conveyor section having a central axis which extends parallel to a central axis of said first loader conveyor means and a relatively short second conveyor section having a central axis which is skewed toward said first loader conveyor means, and a third loader conveyor means extending outwardly from a third one of said feed means, said third loader conveyor means including a relatively long first conveyor section having a central axis which extends parallel to the central axis of said first loader conveyor means and a relatively short second conveyor section having a central axis which is skewed toward said first loader conveyor means, said second and third loader conveyor means being disposed on opposite sides of said first loader conveyor means and extending parallel to said first loader conveyor means throughout at least major portions of their length.

5. An apparatus as set forth in claim 4 wherein the central axis of said second conveyor section of said second loader conveyor means extends parallel to a radius of said circular array of pockets and the central axis of said second conveyor section of said third loader conveyor means extends parallel to a radius of said circular array of pockets.

6. An apparatus as set forth in claim 4 wherein said first loader conveyor means is operable to conduct sheet material in a first lapped stream to said first feed means along a straight path, said second loader conveyor means being operable to conduct sheet material in a second lapped stream to said second feed means, said third loader conveyor means being operable to conduct sheet material in a third lapped stream to said third feed means, said second loader conveyor means including guide surface means for turning the second lapped stream toward the first lapped stream at a location adjacent to said second feed means, said third loader conveyor means including guide surface means for turning the third lapped stream toward the first lapped stream at a location adjacent to said third feed means.

7. An apparatus for use in forming sheet material assemblages, said apparatus comprising a plurality of feed stations disposed in an arcuate array, a circular array of pockets, means for sequentially moving each pocket in said circular array of pockets through a lower portion of each of said feed stations, feed means at an upper portion of each of said feed stations for feeding sheet material downwardly into each of said pockets in turn to form sheet material assemblages, delivery conveyor means for receiving a sheet material assemblages from a lower portion of each of said pockets in turn and conducting sheet material assemblages away from said circular array of pockets, and a plurality of loader conveyor means for supplying sheet material to a plurality of said feed means disposed at adjacent feed stations in the arcuate array of feed stations, said plurality of loader conveyor means including a first loader conveyor means extending outwardly from a first one of said feed means in a direction parallel to a radius of said circular array of pockets and a second loader conveyor means extending outwardly from a second one of said feed means, said second loader conveyor means includes a relatively long first conveyor section having a central axis which extends parallel to a central axis of said first loader conveyor means and a relatively short second conveyor section having a central axis which is skewed toward said first loader conveyor means and extends parallel to a radius of said circular array of pockets.

8. An apparatus as set forth in claim 7 wherein one of said first and second loader conveyor means is disposed above and extends across said delivery conveyor means to one of said feed stations.

9. An apparatus as set forth in claim 7 wherein said plurality of loader conveyor means further includes a third loader conveyor means extending outwardly from a third one of said feed means, said third loader conveyor means including a relatively long first conveyor section having a central axis which extends parallel to the central axis of said first loader conveyor means and a relatively short second conveyor section having a central axis which is skewed toward said first loader conveyor means.

* * * * *